US006363540B1

(12) United States Patent
Myers

(10) Patent No.: US 6,363,540 B1
(45) Date of Patent: Apr. 2, 2002

(54) DRIVERS' SAFETY RESTRAINT

(76) Inventor: Robert E. Myers, 1280 Pinetown Rd., Fort Washington, PA (US) 19034-1704

( * ) Notice: Subject to any disclaimer, the term of this patent is extended or adjusted under 35 U.S.C. 154(b) by 0 days.

(21) Appl. No.: 09/942,507

(22) Filed: Aug. 30, 2001

(51) Int. Cl.[7] ..... A42B 7/00
(52) U.S. Cl. ..... 2/421; 244/122 AG
(58) Field of Search ..... 2/421, 410, 411, 2/416, 425; 244/122 AG; 280/290

(56) References Cited

U.S. PATENT DOCUMENTS

| | | | | |
|---|---|---|---|---|
| 3,099,261 | A | 7/1963 | Doss et al. | 244/1 R |
| 3,170,659 | A | 2/1965 | Wood, Jr. | 244/122 |
| 3,818,509 | A | 6/1974 | Romo et al. | 2/421 |
| 3,925,822 | A | 12/1975 | Sawyer | 2/421 |
| 4,477,041 | A | 10/1984 | Dunne | |
| 4,638,510 | A | 1/1987 | Hubbard | 2/214 |
| 4,664,341 | A | 5/1987 | Cummings | |
| 4,909,459 | A | 3/1990 | Patterson | |
| 4,923,147 | A | 5/1990 | Adams et al. | 244/122 AG |
| 5,123,408 | A | 6/1992 | Gaines | 2/425 |
| 5,261,125 | A | 11/1993 | Cartwright et al. | |
| 5,267,708 | A | 12/1993 | Monson et al. | |
| 5,272,770 | A | 12/1993 | Allen et al. | |
| 5,581,816 | A | 12/1996 | Davis | 2/410 |
| 5,930,843 | A | 8/1999 | Kelly | 2/241 |
| 6,009,566 | A | 1/2000 | Hubbard | |

*Primary Examiner*—John J. Calvert
*Assistant Examiner*—Robert H. Muromoto, Jr.
(74) *Attorney, Agent, or Firm*—Howson & Howson

(57) ABSTRACT

An improved driver's safety restraint utilizes an upwardly open channel formed on the forehead portion of the driver's helmet a strap insertable into the channel and slidable longitudinally in the channel to permit free rotation of the driver's head. The ends of the strap are provided with deformable, substantially non-resilient anchoring rings.

13 Claims, 2 Drawing Sheets

DRIVERS' SAFETY RESTRAINT

FIELD OF THE INVENTION

This invention relates to safety restraints, and particularly to improvements in safety restraints for high performance vehicles such as racing automobiles, to prevent, or at least minimize, head and neck injuries.

BACKGROUND OF THE INVENTION

In automobile racing, at speeds in the neighborhood of 100 to 200 miles per hour or more, even glancing impacts can result in serious injuries to drivers or death. Because of the inertia of the driver's head, in a head-on or side impact collision, the sudden acceleration of the vehicle can cause head injuries due to direct impact of the driver's head with vehicle parts, and also neck injuries due to sudden and severe bending of the driver's neck. Efforts have been made to alleviate the problem of head and neck injuries, by restraining the driver's head movement relative to his body. Examples of restraining devices designed to restrain the driver's head movement relative to his body are described in U.S. Pat. No. 5,272,770 (Allen et al.) and U.S. Pat. No. 6,009,566 (Hubbard). The Allen et al. and Hubbard devices utilize yokes worn on the driver's shoulders and one or more attachments connecting the helmet to the yoke. Other head restraining devices, designed primarily for aircraft use, but incorporating features applicable as well to automobile racing, are described in U.S. Pat. No. 4,477,041 (Dunne), U.S. Pat. No. 4,664,341 (Cummings), U.S. Pat. No. 5,267,708 (Monson et al.), U.S. Pat. No. 4,909,459 (Patterson) and U.S. Pat. No. 5,261,125 (Cartwright et al.).

Although devices utilizing yokes have been effective in reducing head and neck injuries, a substantial number of drivers have chosen not to use them. One reason is that they are difficult to remove, and rapid removal can be critical in the case of a crash involving a fire. Another reason is that the yoke is uncomfortable, especially at the high temperatures encountered in the cockpit of a racing automobile. Still another reason for drivers' resistance to the use of restraint devices utilizing shoulder-worn yokes is that they either prevent, or excessively restrict, rotation of the driver's head about an axis aligned with the cervical vertebrae and extending in the cranial-caudal direction, and thereby limit the driver's effective range of vision to approximately 180° in a horizontal plane.

Other restraints, which connect the driver's helmet to the seat or to other parts of the vehicle are subject to one or more of the above-mentioned drawbacks, or are either too complex to be practical in a racing automobile or have only a limited ability to prevent forward tilting of the driver's head in the case of a head-on collision.

SUMMARY OF THE INVENTION

A general object of the invention is to provide a simple, comfortable, and easily used driver's safety restraint, having improved effectiveness in reducing injuries in a collision.

A preferred driver's safety restraint in accordance with the invention comprises a helmet to be worn on the driver's head, the helmet having a rigid shell for covering at least an upper portion of the driver's head. The rigid shell includes a front portion for covering an upper part of the driver's forehead. The front portion has a convex, curved exterior, and an upwardly open channel extends across the exterior of the front portion. The rear wall of the channel is preferably constituted by a portion of the convex, curved exterior of the shell. The restraint also includes a flexible strap received in the channel and connected at both ends to the seat. The strap is longitudinally slidable in the channel and limited to a length to permit the driver to rotate his or her head freely about the cranial-caudal axis, while preventing substantial forward tilting of the head. The channel is preferably provided with a projection extending from the rear wall of the channel toward the front wall, but spaced from the front wall of the channel by a distance preferably approximately equal to the thickness of the strap, and from the bottom of the channel by a distance at least equal to the width of the strap. This projection ensures that the strap will not slide out of the channel in a collision, but allows the strap to be removed readily from the channel so that the driver can exit the vehicle rapidly. In a preferred embodiment of the invention, the strap is connected to the seat, at the ends of the strap, by deformable, substantially non-resilient, connecting rings having a high degree of toughness. In a collision, the movement of the driver's head stretches and deforms the rings, and consequently, the rings serve as shock absorbers, reducing the likelihood of serious injury to the driver in the event of a sudden stop.

The driver's safety restraint in accordance with the invention affords several notable advantages over previously used safety restraints. The restraining force acts directly on the forehead area of the driver's helmet, through the center of gravity of the driver's head, thereby reducing the likelihood of neck injury resulting from sudden forward movement of the driver's head. The deformable, substantially non-resilient, connecting ring or rings serve as shock absorbers, reducing the magnitude of the force acting on the driver's head in a collision. The strap of the restraint can slide in the channel on the driver's helmet, thereby allowing the driver to turn his head freely, and affording a greater range of vision to the driver. The restraint can be removed easily by the driver or by safety personnel, by sliding the strap out of the channel on the helmet past the strap-retaining projection. The length of the strap can be adjusted easily to accommodate the needs of the driver. Moreover, the parts of the adjustment device can be disconnected from each other, to provide an alternative way in which to remove the restraint from the driver. The strap-receiving channel is preferably molded as an integral part of the helmet, thereby simplifying the restraint and eliminating complex snaps, harnesses and the like, which can interfere with the removal of the driver from the vehicle in an emergency. The restraint is also more comfortable to the driver because it eliminates the need for a shoulder-worn yoke.

Other objects, details and advantages of the invention will be apparent from the following detailed description when read in conjunction with the drawings.

DETAILED DESCRIPTION OF THE PREFERRED EMBODIMENT

Figure 1:
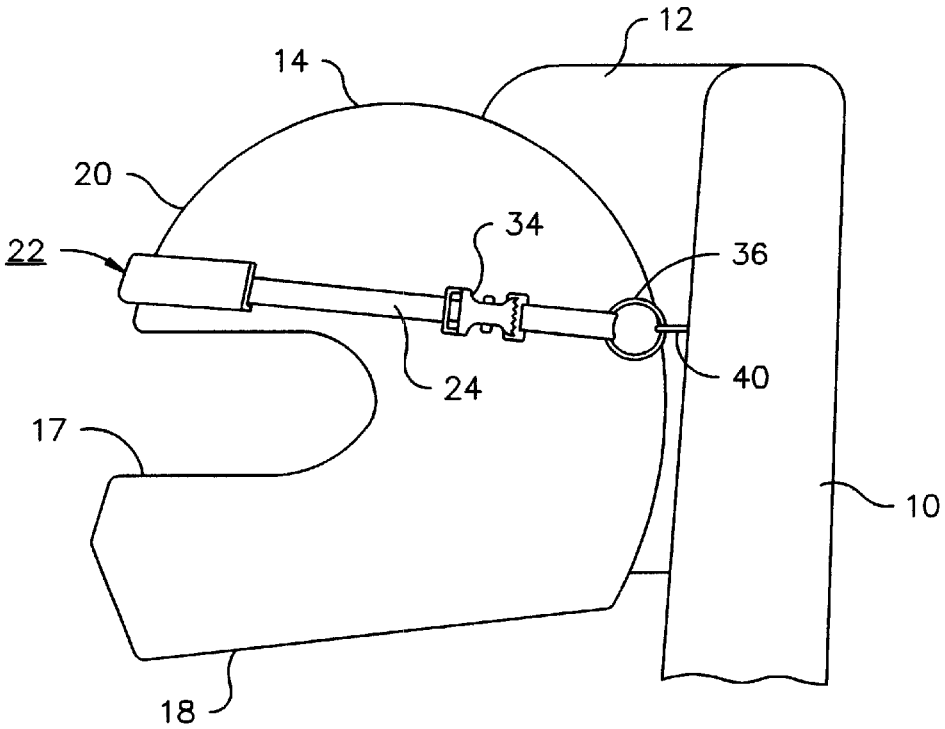
FIG. 1 is a side elevation showing a driver's helmet and safety restraint in accordance with the invention.
Figure 2:
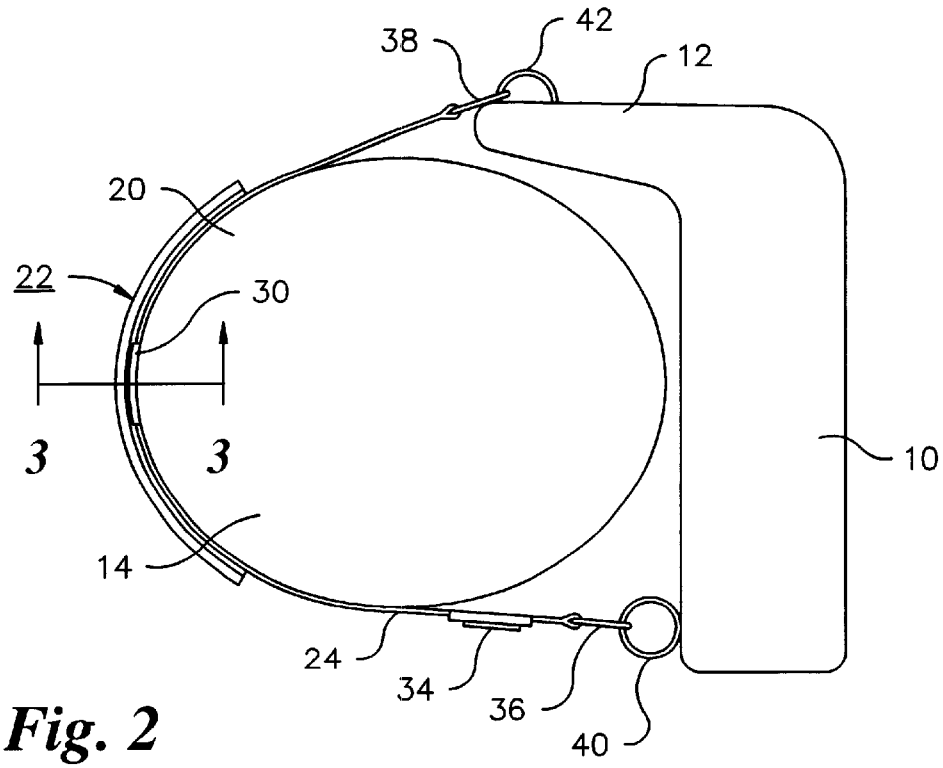
FIG. 2 is a top plan view of the helmet and restraint of FIG. 1.

FIGS. 1 and 2 show the headrest portion 10 of a typical driver's seat in a racing car. The seat shown has a forward-extending side portion 12 for providing lateral support to the driver's head where the race proceeds counterclockwise on an oval track.

The driver's helmet 14, is similar to a conventional, molded racing helmet. It is molded of impact-resistant resin and provided with internal padding (16 in FIG. 3) to fit the driver's head snugly. The particular helmet shown is of the kind that is entirely enclosed except for a front opening 17 and a neck opening 18 at the bottom. The invention, however, is applicable to helmets of other kinds, including helmets in which the driver's chin area is exposed.

The helmet in accordance with the invention differs from the conventional racing helmet primarily in that it is provided, on its forehead portion 20, with a channel 22 for receiving a strap 24 connected at both ends to the seat.

Figure 3:
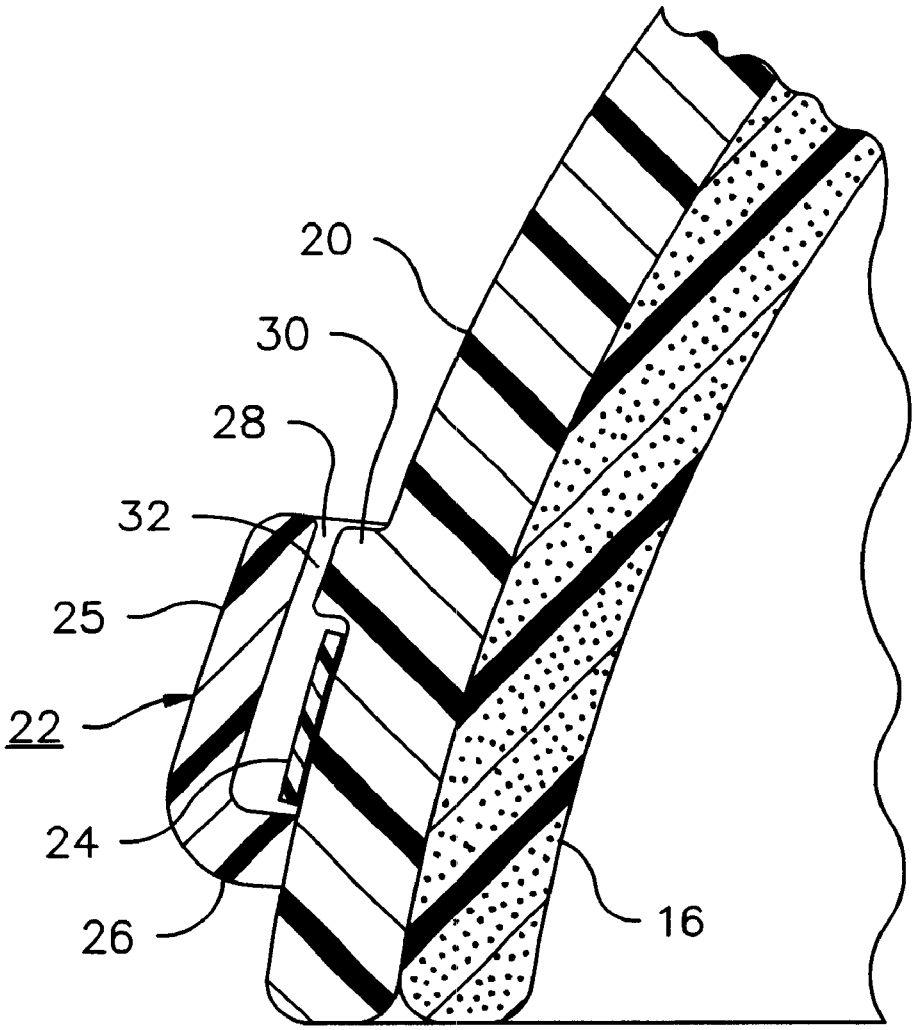
FIG. 3 is a sectional view, taken on plane 3—3 of FIG. 2, showing details of the strap, strap-receiving channel, and strap-retaining projection.

As shown in FIG. 3, the channel 22 comprises a front wall 25, and a rear wall, the rear wall being preferably part of the front surface of the forehead portion of the helmet. A bottom portion 26 of the channel extends from the front wall to the outer surface of the forehead portion of the helmet, and may be permanently secured to the forehead portion of the helmet by an adhesive. The channel has a top opening 28, and the front and bottom walls are curved, as shown in FIGS. 1 and 2, to conform to the shape of the helmet, so that the channel has a uniform width.

An integrally molded projection 30, shown in FIGS. 2 and 3, extends forward from the central portion of the forehead part of the helmet toward the front wall 24 of the channel, but a gap 32 is provided between the projection and the front wall. The width of the gap is preferably approximately equal to the thickness of the strap, but can be somewhat wider than the thickness of the strap without detrimental effect. The projection is preferably positioned above the bottom portion 26 of the channel by a distance slightly greater than the width of the strap. Thus, the strap can be slid vertically downward through gap 32 and positioned in the channel underneath the projection 30 and against the forehead portion of the helmet as illustrated in FIG. 3.

As shown in FIGS. 1 and 2, the strap 24, which is preferably a fabric strap woven of high strength synthetic fibers, is provided with a conventional clip 34, which provides both for length adjustment and for quick disconnection of one portion of the strap from another. The ends of the strap are connected to the seat 10 by deformable rings 36 and 38, which are connected to anchoring rings 40 and 42, respectively. The deformable rings are preferably formed of a soft steel having little or no resilience, and a high degree of toughness, i.e., the ability to withstand high stress and a high degree of deformation without breaking. The deformable rings are preferably located slightly below, but nearly at the same level as that of the channel, so that in the event of a frontal collision, the strap exerts a rearward and slightly downward force on the forehead portion of the helmet, preventing the strap from becoming accidentally disengaged from the channel while minimizing forward movement of the driver's head.

Under ordinary racing conditions, the restraint permits the driver to rotate his head freely through a wide range because the strap is able to slide smoothly in the channel on the forehead area of the helmet. The strap will normally be adjusted to allow some play in the movement of the driver's head, and accordingly the eccentricity of the shape of the helmet will not cause the strap to tighten or loosen excessively as the driver rotates his head. Alternatively, however, the channel and the strap-contacting portions of the helmet can be shaped so that, even if the strap is tight, the driver will be able to rotate his head freely. For example, the channel and the strap-contacting portions of the helmet on either side of the helmet can be configured to conform approximately to a circular arc centered on the cranial-caudal axis of rotation of the driver's head.

Although the restraint in accordance with the invention is designed primarily for use in racing automobiles, it may be adapted for use in boats, aircraft and other high-performance vehicles.

Various modifications can be made to the device described. For example, the side support on the seat, which is important for IRL, dirt track, some CART, and most NASCAR racing, can be eliminated in a racing automobile designed for road racing, for example Formula I and LeMans racing cars. In that case the anchoring rings for the strap will be disposed symmetrically on the headrest of the seat. The anchoring rings can also be provided on parts of the vehicle other than the seat. In the helmet itself, the channel can be molded as a unit with the helmet, or alternatively formed as a separate unit having a U-shaped cross-section rather than an L-shaped cross-section as shown in FIG. 3.

Still other modifications may be made to the apparatus and method described above without departing from the scope of the invention as defined in the following claims.

What is claimed is:

1. A driver's safety restraint for use in a vehicle having a driver's seat, comprising:

a helmet to be worn on the driver's head, the helmet having a rigid shell for covering at least an upper portion of the driver's head, the rigid shell including a front portion for covering an upper part of the driver's forehead, the front portion having a convex, curved exterior;

an upwardly open channel extending across the exterior of the front portion;

a flexible strap having two ends, the strap being received in the channel and being connected at both ends to the seat;

the strap being longitudinally slidable in the channel and limited to a length to permit the driver to rotate his or her head freely about a cranial-caudal axis, while preventing substantial forward tilting of the head.

2. A driver's safety restraint according to claim 1, in which the channel has front and rear walls and a bottom, and including a projection extending from the rear wall toward the front wall, but spaced from the front wall of the channel by a distance at least approximately equal to the thickness of the strap, and from the bottom of the channel by a distance at least equal to the width of the strap.

3. A driver's safety restraint according to claim 1, in which the channel has front and rear walls and a bottom, and including a projection extending from the rear wall toward the front wall, but spaced from the front wall of the channel by a distance approximately equal to the thickness of the strap, and from the bottom of the channel by a distance at least equal to the width of the strap.

4. A driver's safety restraint according to claim 1, in which the convex, curved exterior of the shell constitutes a rear wall of the channel, and the channel also has a front wall and a bottom, and including a projection extending from the rear wall toward the front wall, but spaced from the front wall of the channel by a distance at least approximately equal to the thickness of the strap, and from the bottom of the channel by a distance at least equal to the width of the strap.

5. A driver's safety restraint according to claim 1, in which the convex, curved exterior of the shell constitutes a rear wall of the channel, and the channel also has a front wall and a bottom, and including a projection extending from the rear wall toward the front wall, but spaced from the front wall of the channel by a distance approximately equal to the thickness of the strap, and from the bottom of the channel by a distance at least equal to the width of the strap.

6. A driver's safety restraint according to claim 1, in which the strap is connected to the seat, at least at one end of the strap, by a deformable, substantially non-resilient, connector.

7. A driver's safety restraint according to claim 1, in which the strap is connected to the seat, at least at one end of the strap, by a deformable, substantially non-resilient, connecting ring.

8. A driver's safety restraint according to claim 1, in which the strap is connected to the seat, at both ends of the strap, by deformable, substantially non-resilient, connectors.

9. A driver's safety restraint according to claim 1, in which the strap is connected to the seat, at both ends of the strap, by deformable, substantially non-resilient, connecting rings.

10. A driver's safety restraint according to claim 1, in which the strap is connected to the seat, at both ends of the strap, by deformable, substantially non-resilient, connectors located at a level slightly below the level of the channel so that the strap extends downwardly and rearwardly from the channel.

11. A driver's safety restraint according to claim 1, in which the strap is connected to the seat, at both ends of the strap, by deformable, substantially non-resilient, connecting rings located at a level slightly below the level of the channel so that the strap extends downwardly and rearwardly from the channel.

12. A driver's safety restraint according to claim 1, in which the channel has front and rear walls and a bottom, and including a projection extending from the rear wall toward the front wall, but spaced from the front wall of the channel by a distance at least approximately equal to the thickness of the strap, and from the bottom of the channel by a distance at least equal to the width of the strap, and in which the strap is connected to the seat, at both ends of the strap, by deformable, substantially non-resilient, connectors located at a level slightly below the level of the channel so that the strap extends downwardly and rearwardly from the channel.

13. A driver's safety restraint according to claim 1, in which the channel has front and rear walls and a bottom, and including a projection extending from the rear wall toward the front wall, but spaced from the front wall of the channel by a distance at least approximately equal to the thickness of the strap, and from the bottom of the channel by a distance at least equal to the width of the strap and in which the strap is connected to the seat, at both ends of the strap, by deformable, substantially non-resilient, connecting rings located at a level slightly below the level of the channel so that the strap extends downwardly and rearwardly from the channel.

* * * * *